United States Patent [19]

Miller

[11] 4,423,581

[45] Jan. 3, 1984

[54] CONCEALED FASTENER, STANDING RIB, METAL ROOF PARTS

[76] Inventor: Richard D. Miller, 1947 Warren Rd., Niles, Mich. 49120

[21] Appl. No.: 215,837

[22] Filed: Dec. 12, 1980

[51] Int. Cl.[3] ..... E04D 1/00; E04D 1/36

[52] U.S. Cl. ..... 52/519; 52/531; 52/542; 52/461; 52/462

[58] Field of Search ..... 52/518, 519, 520, 521, 52/530, 531, 543, 544, 549, 551, 542, 537, 522, 461, 462

[56] References Cited

U.S. PATENT DOCUMENTS

| | | | |
|---|---|---|---|
| 453,707 | 6/1891 | Smyth | 52/531 |
| 1,156,053 | 10/1915 | Brown | 52/522 |
| 1,163,556 | 12/1915 | Probert | 52/531 |
| 1,559,967 | 11/1925 | King | 52/522 |
| 1,889,784 | 12/1932 | Harter | 52/519 |
| 3,110,371 | 11/1963 | De Ridder | 52/537 |
| 3,373,534 | 3/1968 | Berridge | 52/544 |
| 3,898,783 | 8/1975 | Matlock et al. | 52/520 |
| 4,133,161 | 1/1979 | Lester | 52/543 |
| 4,223,503 | 9/1980 | Hague | 52/530 |

*Primary Examiner*—John E. Murtagh
*Assistant Examiner*—Michael Safavi
*Attorney, Agent, or Firm*—Barnes & Thornburg

[57] ABSTRACT

A panel assembly for the in-situ production of a standing seam roof has panels which, at one end, have a vertically standing hook formed atop a semi-trapezoidal fold, while at an opposite end, a vertically standing hook is formed atop and is part of a substantially trapezoidal fold. The first hook is designed to be simply and securely retained within the second hook through the use of a camming interlocking action and the free edge of the second end is upwardly bent so as to rest against the semi-trapezoidal fold of a like panel joined to said end to form a series of interconnected panels that are mounted to roof purlins by fasteners hidden by the standing seam. In a roof requiring plural parallel series of panels, upper and lower clamping bars are provided to form a tight, leak-proof lap joint between the adjacent panel series in a manner avoiding the need for the use of exposed fasteners which must extend through exposed roof portions.

18 Claims, 8 Drawing Figures

CONCEALED FASTENER, STANDING RIB, METAL ROOF PARTS

BACKGROUND OF THE INVENTION

1. Field of the Invention

The present invention relates to roof constructions of the type formed by interlocked roof panels. More particularly, the present invention relates to standing rib or seam type roof panel constructions.

2. Description of the Prior Art

Standing seam type roof constructions are well known and enable roof panels to be shipped separately and assembled at the construction site to form a series of interlocked roof panels that extend in series parallel to the roof purlins with each panel extending perpendicular to the roof purlines. The panels are typically similar in length to the combined width of the supporting purlins and the spacing therebetween, and each of the panels is fastened to the supporting purlins in the vicinity of the standing screen. Thus, a typical panel of an interlocked series of panels might be two feet wide by approximately 30 to 40 feet long. If a single series is inadequate, a second interlocked series of panels can be created and positioned so as to extend parallel to the first series with a slight longitudinally extending overlap therebetween.

Most standing seam roof constructions currently in commercial use require the use of special machines for achieving on-site installation thereof and/or result in a roof construction wherein the fasteners for securing the roof panels to the supporting purlins are exposed. On the other hand, it is known from prior patents such as U.S. Pat. Nos. 1,292,960 and 4,106,250, to form standing seam interlocked panel roof construction wherein the roof panels are formed with integral fastening sections which are hidden from view in the assembled roof and avoid the need for the formation of holes through exposed portions of the panels for the purpose of forming a completely installed single series of interlocked panels. Furthermore, the latter mentioned patent also shows an arrangement whereby a leak-free seam is produced between longitudinally adjacent panels without the use of a special machine or rubber mallet to compress or fold the standing seam.

However, in general, the prior art interlocking standing seam panel roof constructions that have been known to data have not always possessed all of the characteristics of utilizing panels that are simple an easy to form, are easily and simply assembled on-site, and are joinable to produce a sturdy leak-free seal without having to mechanically deform the seam. Additionally, while prior art constructions have provided arrangements wherein the fasteners for a given series of interlocked panels are hidden and require no holes through exposed portions of the panels, such has not been the case with respect to overlapping longitudinally extending junctions between adjacent parallelly extending panel series.

SUMMARY OF THE INVENTION

It is an object of the present invention to provide a standing seam type roof construction that is improved so as to be easy to manufacture and simple to install.

It is another object of the present invention to provide a standing seam roof construction wherein longitudinally adjacent panels can be interconnected so as to form a sturdy standing seam that can be mounted through the use of fasteners that are hidden in the finished roof and do not penetrate exposed portions of the panels.

It is still another object of the present invention to provide a standing seam roof construction which enables plural parallel panel series to be securely mounted within the use of exposed fasteners that require holes to be formed through exposed portions of the roof panels.

To this end, preferred embodiments of the present invention utilize panels which, at one end, have a vertically standing hook formed atop a semi-trapezoidal fold, while at an opposite end, a vertically standing hook is formed atop and is part of a substantially trapezoidal fold. The first hook can be simply and securely retained within the second hook through the use of a camming interlocking action, and the free edge of the second end is upwardly bent so as to rest against the semi-trapezoidal fold of a panel joined to said end so as to provide support therefor.

Additionally, in a particularly advantageous embodiment whereby a lap joint is formed between adjacent panel series, a series of upper and lower clamping bars are utilized so as to avoid the need for the use of exposed fasteners which must extend through exposed roof portions. The upper series of clamping bars are designed to interlock with one another and to the standing rib, while the lower series of clamping bars are secured to the purlins by the same fasteners for connecting the panels to the purlins. The lower clamping bars not only serve to co-act with the upper clamping bars in forming a secure leak-free joint, but also create an insulation space beneath the roof panels.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
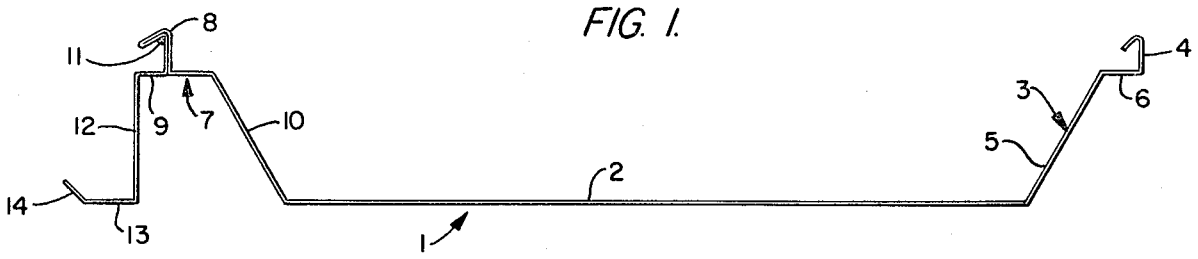
FIG. 1 is a side elevational view of a roof panel in accordance with the present invention.

As can be seen from FIG. 1, a typical panel 1 has a central section 2 which is planar and at each longitudinal end is folded into a configuration for use in producing a standing seam interconnection with a like panel.

Each panel 1 is formed of sheet metal, is approximately 2 to 3 feet wide and sufficiently long as to enable the panel to extend over and between two or more purlins of the building frame to be covered (approximately 30 to 40 feet).

A first end of the panel 3, has a semi-trapezoidal fold at top of which an inwardly facing hook-shaped formation 4 is formed. The semi-trapezoidal fold comprises an outwardly oblique wall 5 and a horizontal wall 6. Preferably, the oblique wall 5 forms equal and opposite obtuse angles with respect to the planar walls 2 and 6. The inwardly facing hook 4 is formed at the free end of horizontal wall 6 by a upward right angle bend followed by an acute angle bend.

At the second, opposite end of the panel 1, a trapezoidal configuration 7 is formed with an integral hook-shaped fold extending upwardly from a central area of a top wall 9. The horizontal wall 9 and the oblique wall 10 are the mirror image of walls 5 and 6, while the hook 8, faces in the same direction as hook 4, but is of a greater acute angle than that of hook 4. Additionally, the hook 8 is provided wit an optional factory applied sealant bend 1 for ensuring a leak-proof seal. The horizontal wall 9 has a downwardly directed right angle bend at its outer edge which forms a vertical wall 12. In turn, the vertical wall 12, which is a continuous load-bearing leg, has a further right angle bend at its lower end that creates a horizontal flange portion 13 that is coplanar with central section 2 and is apertured to enable bolts to be fastened therethrough into supporting purlins upon which the panel is mounted (see FIG. 4). The free edge of wall 13 is angled upwardly as discussed in greater detail below in connection with FIG. 3.

The hook 8 functions as a cam engagement hook, while the portion of wall 9 located thereunder serves as a cam seat for the hook 4. Thus, after mounting of the panel 1 to a supporting purlin by fasteners 15, a second, like panel 1' can be interconnected thereto by holding the panel 1' at an upwardly directed angle to the panel 1 and inserting its hook 4' underneath the hook 8 and resting the outside of the right angle bend formed between wall 6' and hook 4' upon the cam seat of wall 9. The end 7' then can serve, in conjunction with the planar section 2', as an effective lever arm for use in camming (or snapping) the hook 4' into place underneath the hook 8 due to compression of the sealant bead 11.

Figure 3:
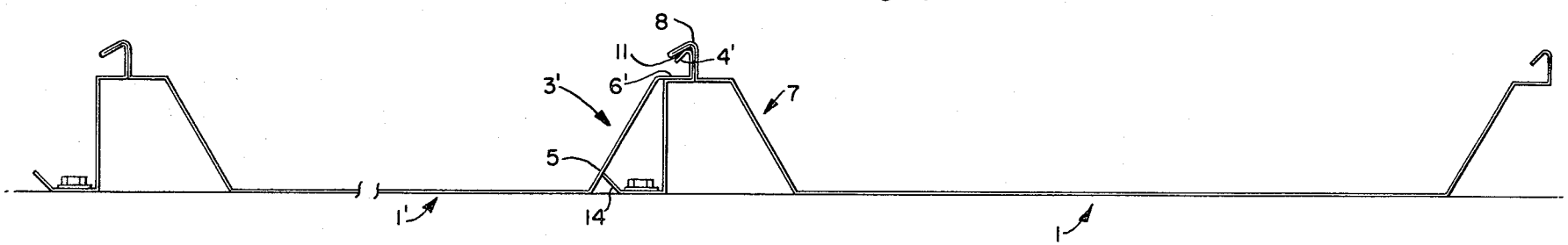
FIG. 3 is a side elevational view showing the panels of FIG. 2 in thir locked and sealed position.

The locked and sealed position of the panels 1 and 1' is shown in FIG. 3. Since the hook 4' is of a lesser acute angle than the hook 8, the sealant bead 11 is able to form an effective, water-tight seal by spreading and filling the space between the free ends of the hooks 8 and 4' in addition to the space between the bends of the hooks 8 and 4'. The combined effects of the interlocked hooks 4' and 8, and the mating of the cam seat surface of wall 9 with the underside of wall 6' ensures a secure locking of the two panels together. Furthermore, proper final orientation of the segments 3' and 7 is ensured by the stop formed by the upwardly angled free edge 14 of the fastening wall 13, which free edge 14 also serves to improve the overall strength of the standing seam box section formed by the interlocked ends 3' and 7. This occurs by forming the free edge 14 of a length and upwardly directed angle which will produce abutment between the free edge 14 and the underside of wall 5 in the FIG. 3 locked and sealed configuration with supplemental angles formed by the edge 14 and wall 5 of approximately 85 to 105 degrees.

From the foregoing, it can be seen that the resultant sealed and locked panel series effectively hides the fasteners 15 and precludes the need for the fasteners to pass through any exposed wall sections. Furthermore, the simple nature of the bends required to produce the configuraton of panel 1 is such that manufacture thereof is simply and relatively inexpensively achieved. Likewise, interconnection of the like panels 1, 1' is simply and easily achieved by virtue of the camming action. This ease with which the hooks 4' and 8 can mate and cam into their locked and sealed position becomes particularly important in view of the fact that the panels 1,1', when constructed so as to extend 30 to 40 feet in length in the direction of the standing seam (direction of arrow X, FIG. 4), are cumbersome to handle and manipulate.

Figure 2:
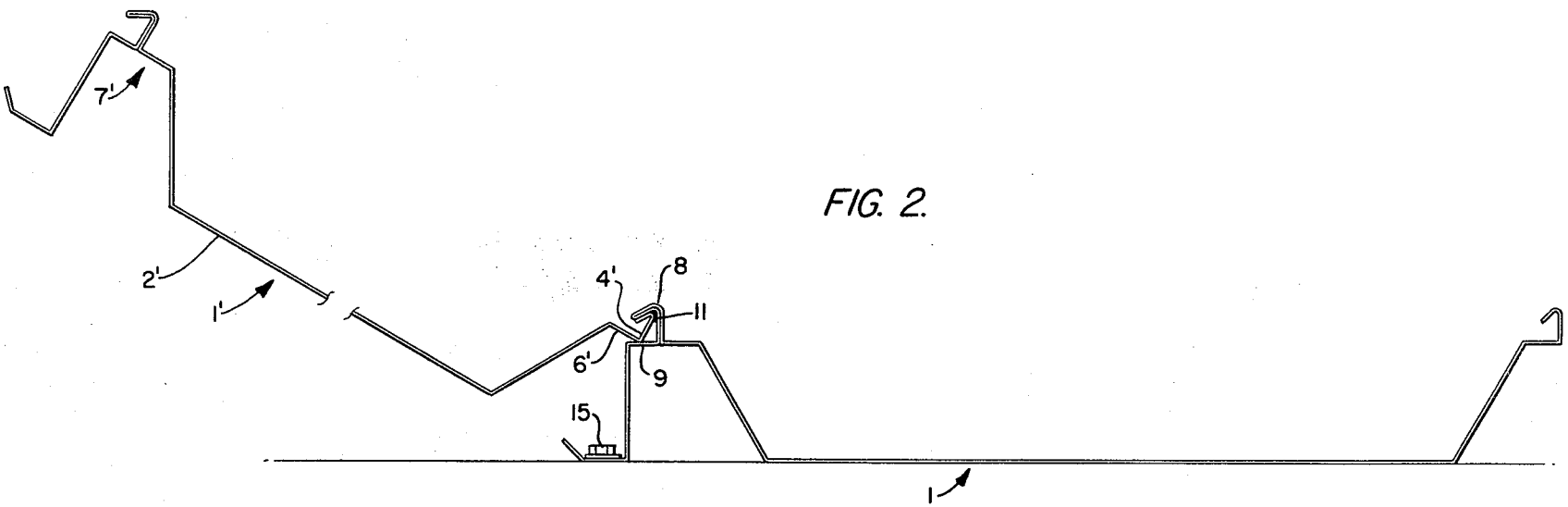
FIG. 2 is a side elevational view illustrating the cam locking action utilized to secure plural panels together in accordance with the present invention.
Figure 4:
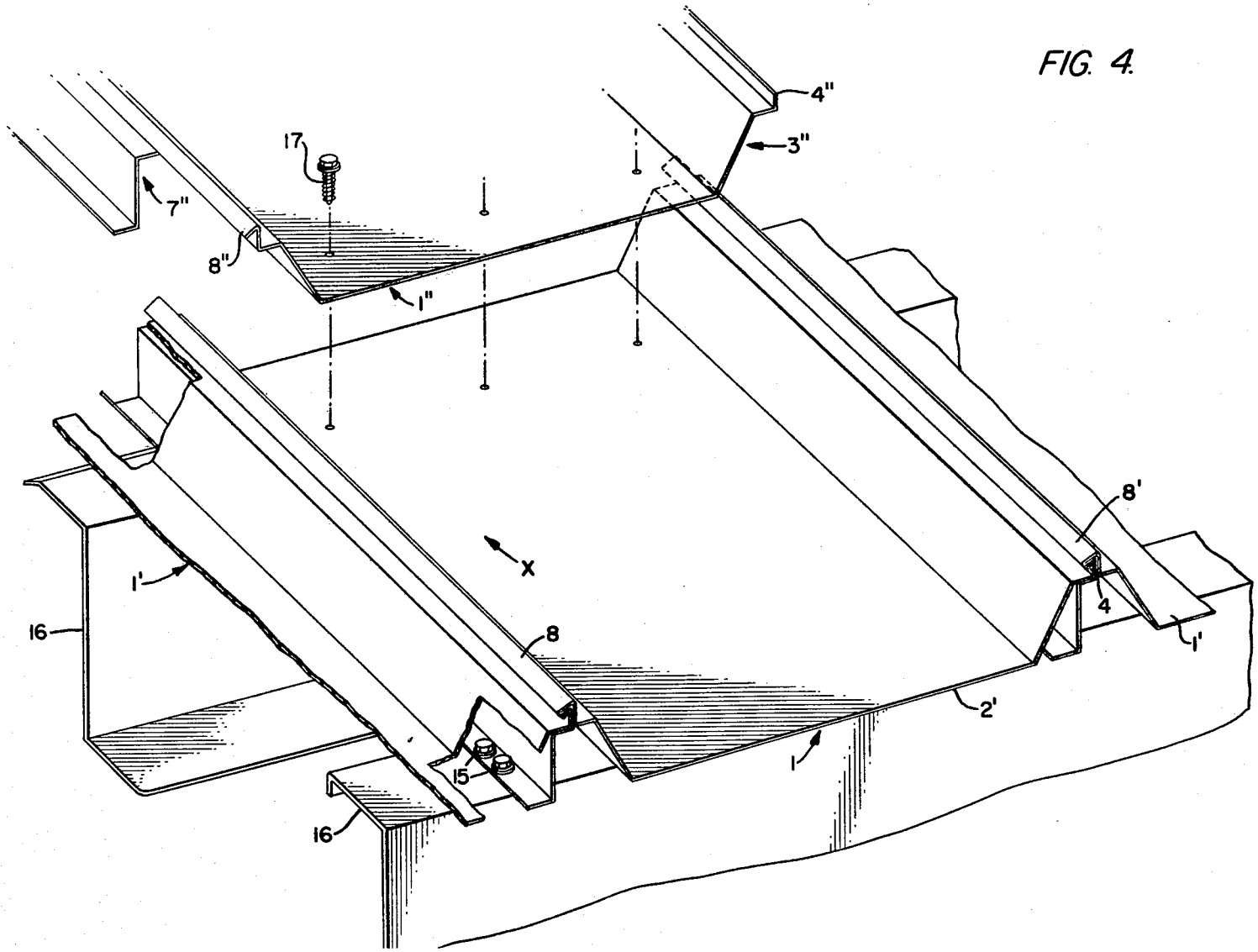
FIG. 4 is a partial perspective, partially exploded view of open arrangement for forming a roof from plural series of panels formed in accordance with the present invention.

As noted above, in some instances, it is necessary to utilize two or more interlocked series of panels. A first arrangement for joining parallel panels is shown in FIG. 4. In this figure, panels 1 and 1' are interconnected and fastened to purlins 16 by fasteners 15 in the manner described in connection with FIGS. 2 and 3. The second and subsequent series of panels 1'' interlock with each other and are fastened by fasteners 15 to purlins 16 also in the same manner described above; however, the corner edge zones of the panels 1'' must be modified in order to enable formation of a longitudinally extending lap joint with the panels 1, 1' of the first series. More particularly, the first or male leg 3'' has the downward sloping portion of the hook 4'' removed so as to create a mere vertical wall for a distance equal to the distance that the panels are to overlap so that this vertical wall can be received underneath the hook 4 of the panel 1 via a camming action similar to that by which the hook 4 would be received under hook 8' of a further panel 1'. On the other hand, the edge 7'' must have the portion of the panel extending from the tip of hook 8'' through to its free edge removed so that the remaining portion of hook 8'' can merely overlap the upper surface of hook 8 and panel 1. Both of these cutaway segments are most advantageously formed in the sheet stock prior to its folding into the FIG. 1 configuration. Fasteners 17 secure panels 1 and 1'' together along the overlap.

Figure 8:
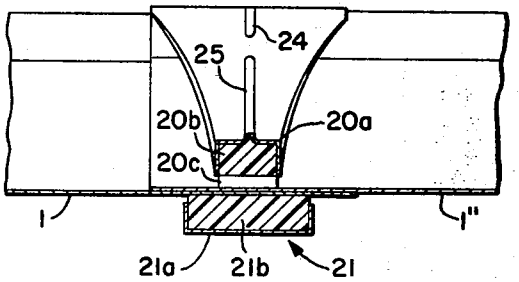
FIG. 8 is a partial transverse cross-sectional view taken alone line VIII—VIII of FIG. 7.
Figure 5:
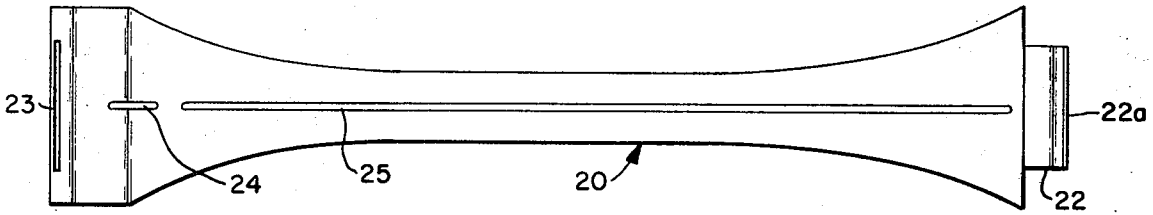
FIG. 5 is a top view of an upper clamping bar for use in joining plural panel series according to a further feature of the present invention.
Figure 6:
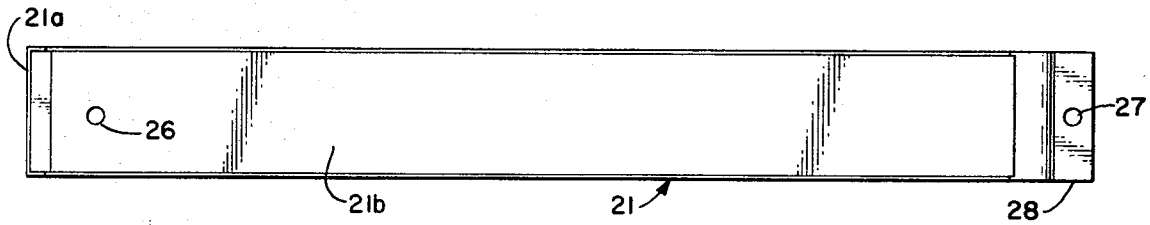
FIG. 6 is a top view of a lower clamping bar for use in conjunction with the upper clamping bar of FIG. 5.
Figure 7:
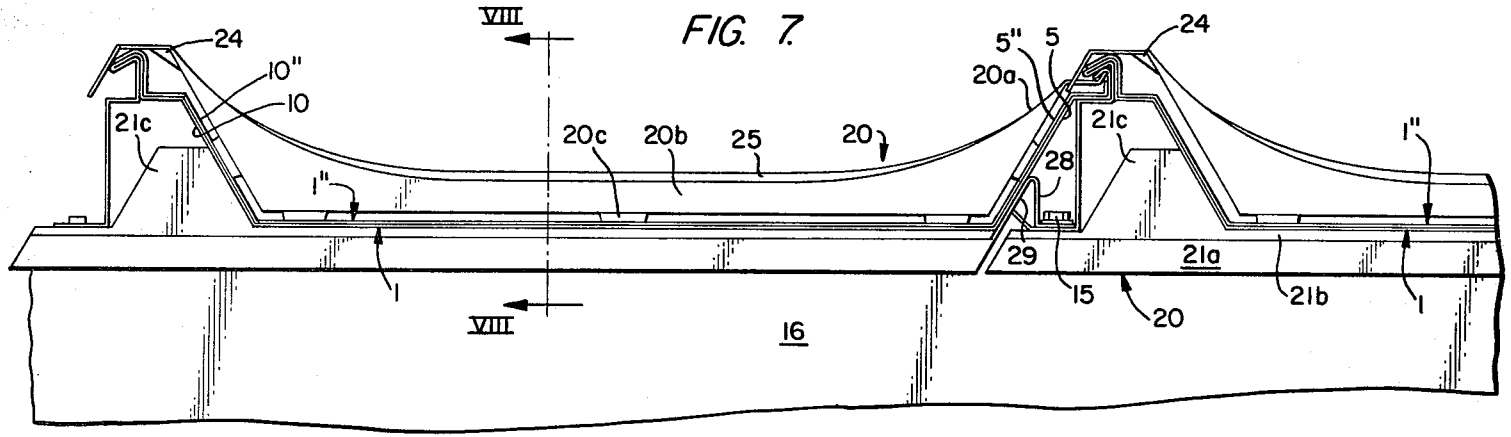
FIG. 7 is a cross-sectional view taken along the lap junction of two adjacent panel series in an embodiment utilizing the clamping bars of FIGS. 5 and 6.

Since the use of fasteners 17 to secure the panels together between the standing ribs is to a certain extent self-defeating of the purpose of utilizing the present invention's concealed fastener arrangement due to the fasteners 17 being exposed and requiring apertures through exposed panel areas, applicant has developed a clamping bar arrangement which obviates the need for fasteners 17. FIGS. 5 and 6 show upper and lower clamping bars 20 and 21, respectively, while FIGS. 7 and 8 show the clamping bars in association with a panel arrangement analogous to that of FIG. 4.

The upper clamping bar 20 has a profile that is essentially hourglass shaped when viewed from above (FIG. 5) with a tab 22 formed on one end and a slot 23 formed in the other end. The upper clamping bar is formed of an upper die stamped steel member **20*a* and a plastic rub strip insert 20*b* received between the side flanges of the steel member 20*a*(FIG. 8). As can be seen from FIG. 7, the top clamping bar has a longitudinally extending concave curve and is provided with reinforcements on its longitudinal centerline in the form of a short groove 24 near the slot 23 and a long upwardly projecting rib 25** that extends throughout most of the concave portion of the clamp bar.

The lower clamp bar 21, like the upper clamp bar 20, is formed of two parts, a lower stamped sheet metal bottom 21*a* and a plastic insert 21*b* received between the side flanges of the steel member 21*a*. Furthermore, the lower clamp bar 21 is also provided with bolt holes 26 and 27 which enable the lower clamping bar to be secured to the purlines by the same bolts 15 used to mount the panels 1. The remaining details of the clamp bar arrangement will be apparent from the discussion of the manner in which they are utilized to produce the construction shown in FIG. 7. In this regard, while only the steps taken with regard to the lap joint side of the panels 1, 1″ are described, it should be appreciated that since the lower clamp bar 21 will raise the height of the panel along the lap joint seam, it will be necessary to install lower clamping bars upon all of the purlins approximately every 5 feet along the panels in the direction X of FIG. 4 so as to raise all portions of the panel series by an equal amount.

The above-noted raising of the panels by the lower clamping bar produces several advantageous results. Firstly, it provides a thermal stop or break between the roof panels and the purlins, the clamping bars being of thermally non-conductive material that inhibits heat transfer between these metal components. Additionally, a clearance space equal to the height of the clamping bars if formed between each pair of clamping bars, and insulation in the form of styrofoam slabs or any other suitable insulation material can be installed therein prior to laying of the panels thereon.

After the first panel 1 is placed upon the requisite number of lower clamping bars and purlins, a like number of lower clamping bars are placed longitudinally adjacent thereto with tab 28 arranged so that its hole 27 is aligned with the like bolt receiving hole in the wall 13 of the panel member. The hole is arranged in a horizontal outer edge of the tab 28 which is joined to an inverted V-shaped inner portion of the tab that has a wall 29 that is of the same inclination as the wall 5 of a panel 1 and against which the panel stop 14 will abut. The bolts 15 will be inserted through the hole 27, the hole in the panel wall 13, the hole 26 of the clamp bar supporting said panel and into the purlin.

At this stage of the assembly process, either the corresponding panel(s) of the adjacent parallel series of panels can be put into place, or this can be done after completion of the entire first series of panels. After a lap joint has been formed between two panels 1, 1″ of two adjacent series of panels, (FIG. 8), the upper clamp bars can be put into place. This is done by holding the clamp bar at an upwardly inclined angle that enables the bent tip 22*a* of the tab 22 to pass through the slot 23 of the longitudinally preceding upper clamp bar, and after insertion of which the upper clamp bar tab 22*a* is pushed through the slot 23 and lowered in a manner which enables the tab 22*a* to hook underneath the hook 8 of the panel 1 upon which it then rests supported upon rub bars 20*c* of the rub strip inserts 20*b*. When this process is completed with all of the upper clamp bars, they will be securely held at both ends due to the interlocking of the upper rub strips with each other and the hooks 8 of the panels 1 in a manner securely clamping the panels 1 1″ together in the area of the lap joint in conjunction with the lower clamp bars 21. In this regard, it can be seen from FIG. 7 that the wall 29 of lower clamping bar 21's tab 28 co-acts with the upwardly inclined rub bar 20*c* on the tab end of upper bar 20 to secure the lap joint at the walls 5, 5″ at one standing seam, while an enlarged wedge-shaped formation 21*c* is provided on the rub strip 21*b* of the lower clamping bar 21 so as to support the walls 10, 10″ of a second standing seam and so as to co-act with an oppositely facing upwardly inclined rub bar 20*c* of the upper clamping bar 20. Any number of further intermediate rub bars 20*c* can be spaced horizontally along the bottom of plastic insert 20*b* so as to clamp the panels 1, 1′ against the horizontal extent of insert 21*b* between the wedge 21*c* and the wall 29. Thus, the clamping bar assembly of bars 20 and 21 assures clamping at all points where it is in contact with the roof panels, and resists wind uplift. Furthermore, while the clamping bars 28, 21 have been described for use with standing seam panels of the type described herein, it is noted that they are also readily adaptable to use with other interlocking panel standing seam roof constructions.

From the foregoing, it should be apparent that the present invention provides an arrangement that enables standing seam roofs to be constructed in a fast and easy manner, that creates leak-free connections between interlocked panels of a series and between panels of adjacent series and which also avoids exposed fasteners and holes passing through exposed panel portions. Additionally, clamping bars in accordance with the invention provide a thermal break between the roof panels and purlins, and also insures against wind uplift.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Panel assembly, for the in-situ production of a standing seam roof including a roof panel having a planar section, a semi-trapezoidal folded portion extending across one edge of said planar section and at top of which is formed an inwardly facing, hook-shaped formation, a trapezoidal folded portion extending across one edge of said planar section and at top of which is formed an inwardly facing, hook-shaped formation, a trapezoidal folded portion extending across an opposite edge of said planar section and at top of which is formed an outwardly directed hook-shaped formation, and a horizontal fastening flange extending outwardly from a load supporting leg of said trapezoidal folded portion for fastening the panel to roof purlins wherein said outwardly directed hook-shaped formation defines an acute, cam engagement angle that is greater than an acute angle defined by said inwardly facing hook-shaped formation and which serves with a cam receiving seat formed by an upper horizontal wall portion of said trapezoidal portion located immediately thereunder for enabling a camming snap-in interconnection to be achieved between said cam engagement angle and cam engagement seat of said panel and an inwardly facing hook-shaped formation and upper horizontal wall of a semi-trapezoidal folded portion of another, like roof panel to form a series of panels with said fastening leg being hidden under the semi-trapezoidal folded portion of said like roof panel, comprising a plurality of said roof panels for interlocking into said series of panels, plural modified roof panels for interlocking into a second series of panels, and upper and lower clamping bars for clamping together adjacent panels of said first and second series in a partially overlapping manner therebetween, wherein said modified panels correspond to said roof panels except for corner portions of said fastening edge, trapezoidal folded portion, outwardly directed hook-shaped formation, and inwardly facing hook-shaped formation which are removed, wherein each of said upper clamping bars has a tab at one end and a slot at an opposite end, said tab being configured for passing through said slot on a like upper clamping bar and interlocking underneath said snap-in interconnection, and wherein each lower clamping bar has an aperture at both ends for enabling fastening thereof to said roof purlins.

2. Panel assembly according to claim 1, wherein said upper and lower clamping bars are formed of stamped sheet metal parts having plastic rub-strip thermo-break inserts.

3. Panel assembly according to claim 2, wherein the lower clamping bar has upwardly sloping surfaces which are parallel to oblique wall surfaces of said trapezoidal and semi-trapezoidal folds for supporting same, and wherein the rub-strip of the upper clamping bar has projecting obliquely angled rub-bars for clamping said oblique wall surfaces against sloping surfaces of said lower clamping bar and horizontal rub-bars for clamping said planar section of the panels against a planar surface of the rub-strip insert of the lower clamping bar.

4. Panel assembly according to claim 3, wherein said upwardly sloping surfaces of the lower clamping bar comprise a surface of an enlarged wedge-shaped formation forming part of the rub-strip of the lower clamping bar near one end thereof and a wall surface of an inverted V-shaped bend in a fastening tab portion of the stamped sheet metal part at an opposite end of said lower clamping bar.

5. Panel assembly according to claim 1, wherein said fastening flange is provided with an upwardly angled free edge, said free edge forming a stop of abuttingly engaging the underside of said semi-trapezoidal folded portion of said like roof panel upon formation of said snap-in interconnection.

6. Panel assembly according to claim 3, wherein said fastening flange is provided with an upwardly angled free edge, said free edge forming a stop for abuttingly engaging the underside of said semi-trapezoidal folded portion of said like roof panel upon formation of said snap-in interconnection.

7. A clamping bar assembly for clamping together a lap-joint between a first and a second parallelly extending series of roof panels of the type wherein each of the panels has a planar section bounded by end portions having hook-shaped portions, and wherein hook-shaped portions of adjacent panels of each series are interlocked to form a standing seam joint, said clamping bar assembly comprising:

(a) an upper clamping bar having lower, panel clamping surfaces for engaging an upper surface of said lap-joint, a first end of said upper clamping bar being shaped for resting upon a first standing seam joint of said series, said first end having an aperture therein, and a second end of said upper clamping bar being shaped so as to be passable through the aperture in the first end of a like upper clamping bar and so as to hook underneath interlocked hook-shaped portions of a successive, second standing seam joint; and (b) a lower clamping bar having upper, panel clamping surfaces positioned between apertured end portions, and a lower surface for resting upon roof panel supporting purlins;

wherein said lap-joint is clampable between said panel clamping surfaces of the upper and lower clamping bars.

8. A clamping bar assembly according to claim 7, wherein said clamping surfaces of the upper and lower clamp bars are formed of plastic, thermo-break, rub-strips.

9. A clamping bar assembly according to claim 8, wherein said rub-strips are inserts secured within stamped sheet metal parts.

10. A clamping bar assembly according to claims 7 or 9, wherein said clamping surfaces of each of the upper and lower clamping bars comprise at least one central planar surface and at least one upwardly angled surface on each of said longitudinally opposite sides of said central planar surfaces.

11. Panel assembly for the in-situ production of a standing seam roof or the like, comprising a sheet material panel having:

a middle section, a first folded portion extending along one edge of said middle section, said first folded portion including a first hook-shaped formation which opens generally inwardly toward said middle section, a second folded portion extending along an opposite edge of said middle section, said second folded portion including a second hook-shaped formation which opens generally outwardly away from said middle section, and a fastening flange extending from a load supporting leg of said second folded portion in a direction outwardly of said middle section for accommodating fastening means to fasten the panel directly to roof purlins or the like, wherein said second hook-shaped formation defines an acute cam engagement angle that is greater than an acute angle defined by said first hook-shaped formation and which serves with a cam receiving seat formed by an upper generally horizontal section of said second hook-shaped formation to enable a camming snap-in interconnection with a first hook-shaped portion of an adjacent roof panel with the fastening flange being hidden under the first folded portion of the adjacent panel when in an assembled position, whereby a series of adjacent panels can be assembled by first fixedly fastening the fastening flange of a panel directly to a roof purlin, followed by a camming snap-in interconnection of the next adjacent panel, without requiring additional connection parts.

12. Panel assembly according to claim 11, wherein said first folded portion exhibits a generally semi-trapezoidal-shaped cross-section with said first hook-shaped formation located at the top thereof, wherein said second folded portion exhibits a generally trapezoidal-shaped cross-section with said second hook-shaped formation located at the top thereof, one side of said trapezoidal-shaped cross-secton forming said load supporting leg.

13. Panel assembly according to claim 11, wherein said fastening flange is provided with an upwardly angled free edge, said free edge forming a stop for abuttingly engaging the underside of said semi-trapezoidal folded portion of said like roof panel upon formation of said snap-in interconnection.

14. Panel assembly according to claim 13, wherein said load supporting leg of the trapezoidal folded portion extends vertically and an opposite wall of said trapezoidal folded portion is obliquely inclined toward said load supporting leg.

15. Panel assembly according to claim 12, wherein said cam receiving seat is formed at the upwardly facing surface at the top wall of the trapezoidal-shaped cross section.

16. Panel assembly according to claim 12, wherein said fastening flange is provided with an upwardly angled free edge, said free edge forming a stop for abuttingly engaging the underside of said semi-trapezoidal folded portion of said like roof panel upon formation of said snap-in interconnection.

17. Panel assembly according to claim 12, wherein said load supporting leg of the trapezoidal folded portion extends vertically and an opposite wall of said trapezoidal folded portion is obliquely inclined toward said load supporting leg.

18. Panel assembly according to claim 13, comprising a sealant bead affixed within said cam engagement angle.

* * * * *